United States Patent [19]

Matsui et al.

[11] Patent Number: 4,883,113

[45] Date of Patent: Nov. 28, 1989

[54] POURING DEVICE FOR DUAL-ROLL TYPE CONTINUOUS CASTING MACHINE

[75] Inventors: Kunio Matsui, Yokohama; Hisahiko Fukase, Tokyo; Atsushi Hirata, Hiratsuka; Akihiro Nomura, Yokohama, all of Japan

[73] Assignee: Ishikawajima-Harima Jukogyo Kabushiki Kaisha, Japan

[21] Appl. No.: 280,139

[22] Filed: Dec. 5, 1988

[30] Foreign Application Priority Data

Mar. 3, 1988 [JP] Japan ..... 63-50017[U]
Mar. 3, 1988 [JP] Japan ..... 63-28574

[51] Int. Cl.[4] ..... B22D 11/06

[52] U.S. Cl. ..... 164/428; 164/477; 164/438; 164/400

[58] Field of Search ..... 164/428, 437, 438, 480

[56] References Cited

U.S. PATENT DOCUMENTS 2,128,941 9/1938 Hudson .
4,694,887 9/1987 Matsui et al. ..... 164/428
4,784,208 11/1988 Fukase et al. ..... 164/480
4,804,037 2/1989 Nomura et al. ..... 164/428

FOREIGN PATENT DOCUMENTS 77962 6/1980 Japan .
193739 11/1984 Japan ..... 164/428
21156 2/1985 Japan ..... 164/437
21171 2/1985 Japan ..... 164/437
27449 2/1985 Japan .
60-216956 10/1985 Japan .
61-165257 7/1986 Japan .
195747 8/1986 Japan .

*Primary Examiner*—Kenneth J. Ramsey
*Assistant Examiner*—Edward A. Brown

[57] ABSTRACT

The flow rate of melt flowing through each end face of a core toward the inner surface of a side dam in opposed relationship with each end face is variable by a side-dam-wise flow passage defined within the core, whereby various problems caused at the so-called triple-point zones can be substantially solved.

8 Claims, 4 Drawing Sheets

POURING DEVICE FOR DUAL-ROLL TYPE CONTINUOUS CASTING MACHINE

BACKGROUND OF THE INVENTION

The present invention relates to a pouring device for dual-roll type continuous casting machines.

A conventional dual-roll type continuous casting machines comprises, as shown in FIG. 1, a pair of cooling rolls disposed in parallel with each other in a spaced-apart relationship as well as side dams 2 disposed at both end faces of the cooling rolls 1, whereby a basin 3 is defined into which a core 4 is partially submerged. Melt 6 such as molten steel in a tundish 5 above the core 4 flows down through a vertical passage 9 extending through the core 4 into the basin 3. Melt 6 is cooled by the cooling rolls 1 which rotates in directions indicated by the arrows so that a solidified shell 7 is formed and a casting 8 continuously leaves through the gap between the cooling rolls 1 out of the continuous casting machine.

In the dual-roll type continuous casting machine described above, melt 6 in the basin 3 is cooled by the cooling rolls 1, forming the solidified shell 7 over the cylindrical surfaces of the cooling rolls 1. In this case, the solidified shell 7 tends to grow at the so-called triple-point zones (i.e., zones of contact between the cooling rolls 1, the side dams 2 and melt 6) since melt 6 tends to tarry and thus tends to be sooner cooled at the triple-point zones. The solidified shell 7 which has grown upon the stationary side dams 2 is cooled, dropped therefrom by the rotating cooling rolls 1 and is crushed in the gap between the cooling rolls 1 so that there may arise the problems that the surface quality of the casting 8 is degraded; the thickness of the casting 8 is locally increased; the casting 8 is sheared; and the side dams 2 are damaged due to the drop of the solidifed shell 7 therefrom.

In order to solve the above and other problems, there has been devised and demonstrated a pouring device with an additional passage 12 as shown in FIG. 2. The passage 12 is opened at the surface of the core 4 in opposed relationship with the corresponding side dam 2 and extends through the core 4 so that part of the poured melt 6 is forced to flow through the passage 12 toward the so-called triple-point zones in the basin 3, thereby preventing the growth of the solidified shell 7 at the triple-point zones and especially at the side dams 2.

However, with the above-described pouring device, the flow rate of melt 6 flowing toward the side dam 2 is predeterminedly set so that any irregular and abnormal states of the solidified shell 7 growing at the triple-point zones cannot be compensated with, resulting in a problem that shapes of the widthwise edges of the casting 8 may be degraded due to any variations in casting conditions. The gap between the opposing surfaces of the core 4 and the side dam 2 may uncontrollably vary in response to variations in temperature of melt, resulting in variations in flow rate of melt 6 which can not be compensated with.

In view of the above, a primary object of the present invention is to provide a pouring device capable of varying the flow rate of melt to be supplied to the so-called triple-point zones in response to the growing conditions of the solidified shell and the unsteady state thereof.

The above and other objects, effects features and advantages of the present invention will become more apparent from the following description of some preferred embodiments thereof taken in conjunction with the accompanying drawings.

DETAILED DESCRIPTION OF THE PREFERRED EMBODIMENTS

Figure 1:
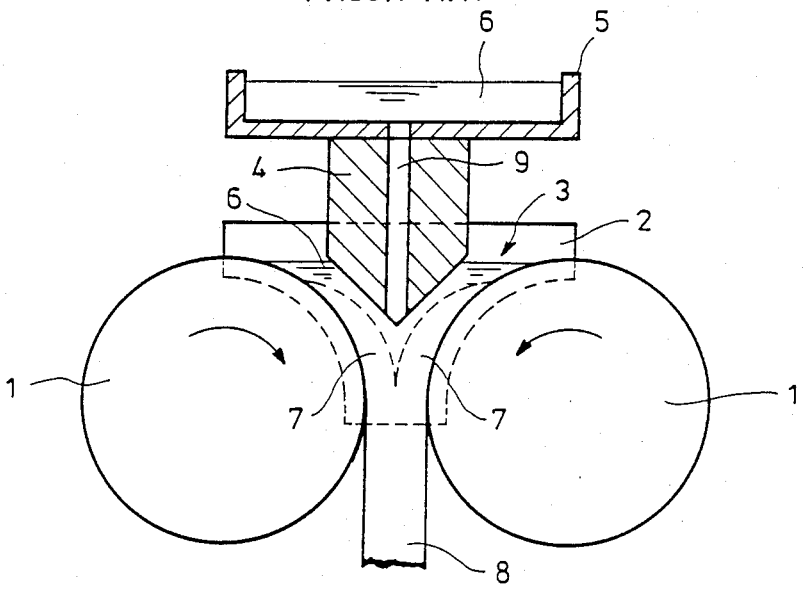
Fig. 1 PRIOR ART
FIG. 1 is a cross sectional view of a conventional dual-roll type continuous casting machine.
Figure 2:
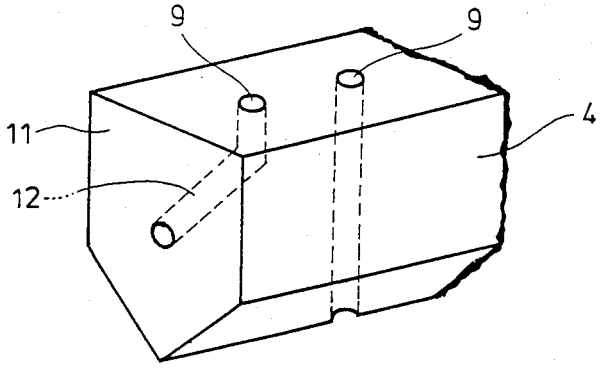
Fig. 2 PRIOR ART
FIG. 2 is a perspective view of a core thereof.
Figure 3:
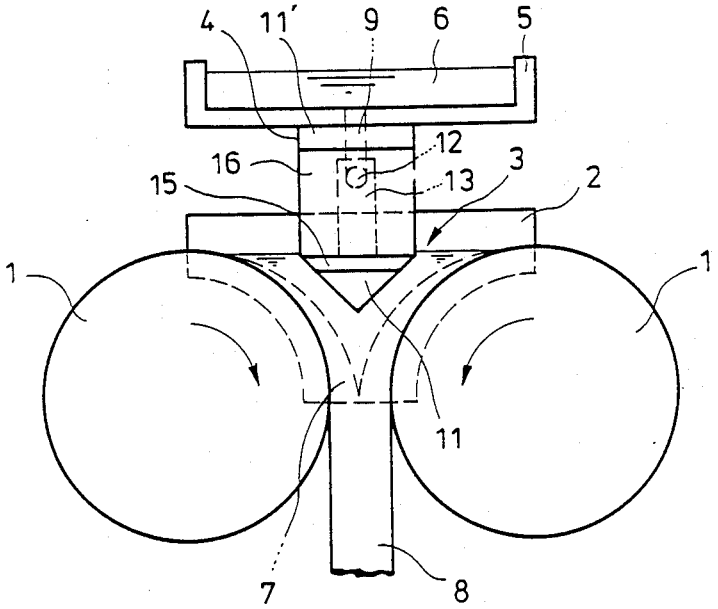
FIG. 3 is a front view of a first preferred embodiment of a dual-roll type continuous casting machine in accordance with the present invention.
Figure 4:
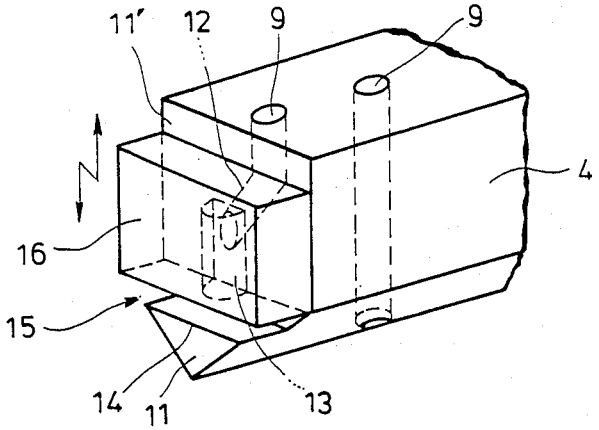
FIG. 4 is a perspective view of a core thereof.

FIGS. 3 and 4 show a first preferred embodiment of the present invention. A pair of rotating cooling rolls 1 are disposed in parallel and spaced apart from each other by a suitable distance and side dams 2 are made into contact with both the end surfaces of the cooling rolls 1 to thereby define together a basin 3 into which a core 4 is supported to be partially submerged. A plurality of vertical melt-flow passages 9 are formed through the core 4 so that melt 6 in a tundish 5 disposed above the core 4 flows into the basin 3. The vertical passages 9 are spaced apart from each other by a suitable distance in the widthwise direction at the center portion of the gap between the cooling rolls 1. Each of the outermost passages 9 of the core 4 is bent toward the side dam 2 to define a side passage 12 opened at a vertical surface 11' of a step of the end surface 11 of the core 4 in opposed relationship with the side dam 2. Disposed between the vertical step surface 11' and the side dam 2 is a vertically movable sliding side plate 16 which has a downwardly extending flow passage 13 in communication with the side flow passage 12. A horizontal flow passage 15 is defined between the lower end surface of the sliding side plate 16 and the horizontal surface 14 of the step formed at the lower end portion of the core 4. The horizontal flow passage 15 is located adjacent to the level of melt 6 in the basin 3. Vertical motion of the sliding side plate 16 is effected by an actuator such as a cylinder (not shown).

Melt 6 supplied into the tundish 5 is directly poured through the vertical passages 9 extending through the core 4 in the mid-portion thereof in the widthwise direction thereof, into the basin 3; but at each widthwise end portion, melt 6 flows through the vertical passage 9, the side passage 12, the vertical passage 13 formed in the vertically slidable side plate 16 and the horizontal passage 15 so that melt 6 flows over the inner surface of the side dam 2. Therefore, the growth of the solidified shell on the side dam 2 can be avoided so that the above-described triple point problems can be solved.

Even with the core 4 of the type described above, when the casting conditions vary or the temperature of melt varies at the steady state in the initial casting stage, the gap between the opposing surfaces of the core 4 and the side dam 2 may vary to change to the flow rate of melt flowing toward the side dam 2, resulting in degradation of the shapes of the widthwise sides of the casting 8.

In this case, the vertical position of the sliding side plate 16 is adjusted to vary the cross sectional area of the horizontal flow passage 15 so that melt 6 flows at an optimum flow rate toward the side dam 2, whereby the correct cross section of the casting 8 can be ensured.

Figure 5:
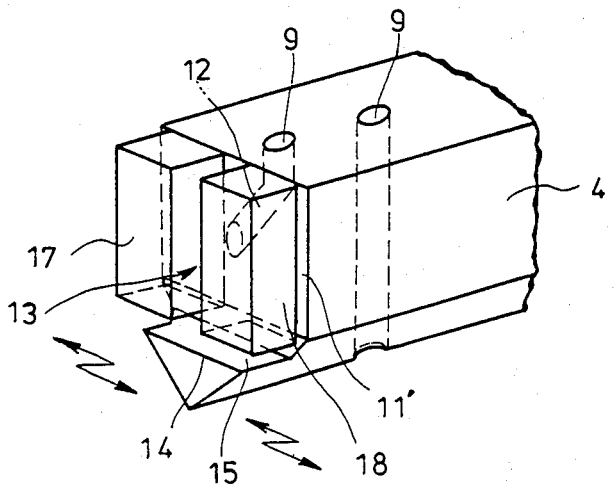
FIG. 5 is a perspective view of a second preferred embodiment of a core in accordance with the present invention.

Referring next to FIG. 5, a second preferred embodiment of the present invention will be described in which a pair of sliding side plates 17 and 18 are disposed on the vertical step surface 11' such that the side flow passage 12 is opened at the vertical flow passage 13 between the sliding side plates 17 and 18. The horizontal flow passage 15 is defined by the lower end surfaces of the sliding side plates 17 and 18 and the horizontal step surface 14.

According to the second embodiment, the sliding side plates 17 and 18 are moved toward or away from each other in the directions indicated by the two-pointed arrows by an actuator means (not shown) so the cross sectional area of the vertical flow passage 13 is varied, thereby adjusting the flow rate of melt flowing toward the side dam 2.

Figure 6:
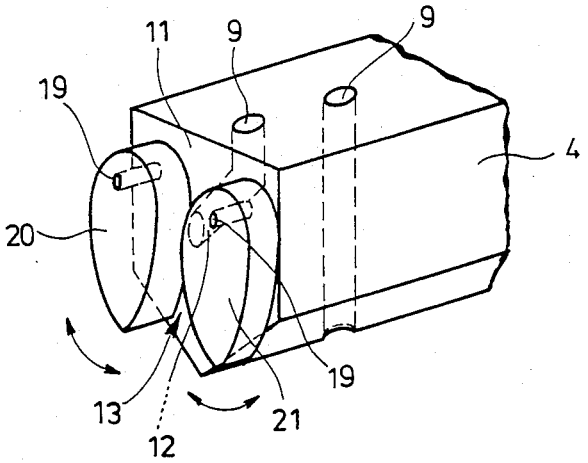
FIG. 6 is a perspective view of a third preferred embodiment of a core of the present invention.

FIG. 6 shows a third preferred embodiment of the present invention in which pins 19 extend at the positions adjacent to the upper surface of the core 4 and perpendicularly on the end surface 11 thereof which in turn is spaced apart from the opposing inner surface of the side dam 2 by a suitable distance such that the pins 19 are symmetrical about the opening of the side passage 12 at the side surface 11 of the core 4 and are spaced apart from each other by a suitable distance. Sliding side plates 20 and 21 which are sized to have their opposing inner side surfaces in spaced-apart relationship are pivoted with the pins 9 to the end surface 11 of the core 4 so that the opposing side surfaces of the plates 20 and 21 define the vertical passage 13. When the plates 20 and 21 are caused to swing about their corresponding pivot pins 9 outwardly (that is, in the directions toward the cooling rolls 1), the vertical flow passage 13 is increased in width so that the flow rate of melt flowing toward the side dam 2 can be increased. On the other hand, when the plates 20 and 21 are caused to swing inwardly toward each other, the vertical passage 13 is decreased in width so that the flow rate of melt flowing toward the side dam is decreased.

Figure 7:
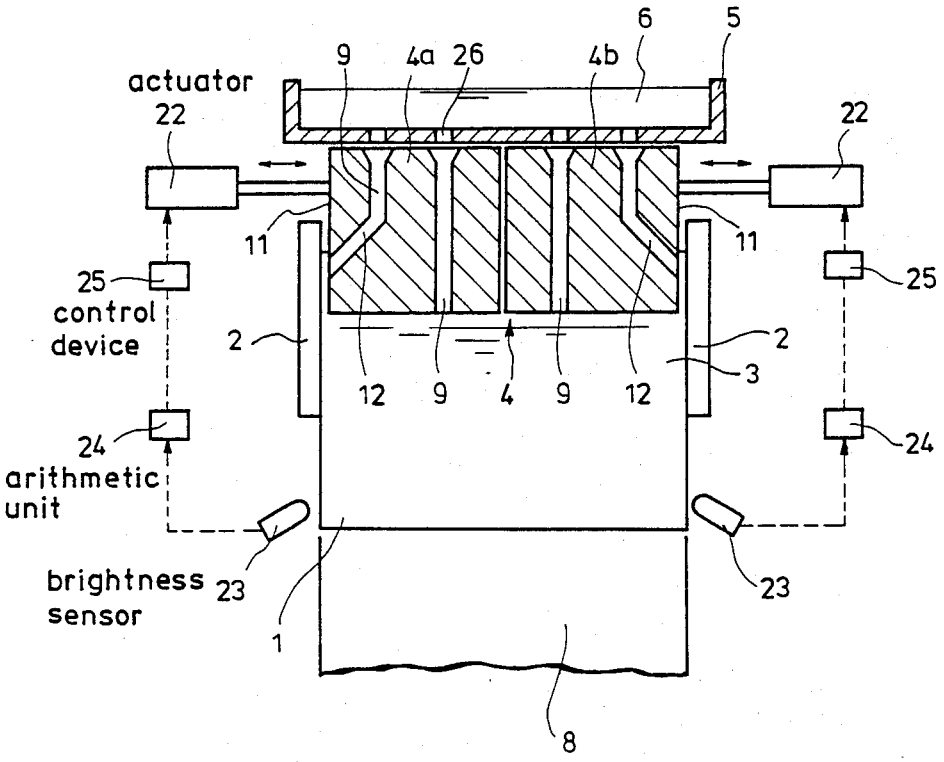
FIG. 7 is a side sectional view of a fourth preferred embodiment of a continuous casting machine in accordance with the present invention.

FIG. 7 shows a fourth preferred embodiment of the present invention. As described in the first embodiment with reference to FIGS. 3 and 4, a pair of rotating cooling rolls 1 are disposed in parallel with each other and are spaced apart from each other by a suitable distance in the horizontal direction and side dams 2 are made in contact with the end surfaces, respectively, of the cooling rolls 1 to thereby define together a basin 3. The core 4 is divided perpendicular to and at the mid-point in the widthwise direction of the cooling rolls 1 into two subcores or divided cores 4a and 4b which are sized to define a predetermined gap between the opposing surfaces of the sub-core 4a and 4b and the side dams 2. The sub-cores 4a and 4b have their lower end portions submerged in the basin 3 when they are moved in the widthwise direction of the cooling rolls 1. In order to supply melt 6 in the tundish disposed above the core assembly 4 to the basin 3, a plurality of vertical flow passages 9 are formed through the core assembly 4 and spaced apart from each other by a suitable distance in the widthwise direction of the cooling rolls 1. In each of the sub-cores 4a and 4b, a flow passage 12 is formed which is communicated with the outermost vertical passage 9 and is opened at the end surface 11 of the core 4 in opposed relationship with the inner surface of the side dam 2. Actuators 22 which are drivingly coupled to the sub-cores 4a and 4b for movement of the latter toward or away from the corresponding side dams 2 are disposed at the positions, respectively, which are spaced apart outwardly from the upper portions of the side dams 2. The upper end of each vertical flow passage 9 is enlarged like a countersink to maintain the upper end in communication with the pouring holes 26 of the tundish 5 even when the subcores 4a and 4b are displaced.

Brightness or luminance sensors 23 for detecting a degree of luminance at the edges of the casting 8 are disposed immediately below the side dams, respectively, at the mid-point between the cooling rolls 1. Outputs from the brightness sensors 23 are transmitted to arithmetic units 24 which in turn compute the operation strokes of the actuators 22 in response to the received outputs and deliver the operation instructions to control devices 25 for the actuators 22.

When the flow rate of melt 6 supplied along the surface of the side dam 2 to the so-called triple-point zone is too high during the casting operation, the solidification of the shell 7 is delayed at the triple-point zones so that a degree of luminance or brightness of the edges of the casting 8 is increased. On the other hand, when the flow rate is too low, the abnormal growth of the solidified shell 7 occurs at the triple-point zone so that a degree of luminance or brightness of the edges of the casting 8 is decreased. The present invention utilizes such phenomenon. More specifically, a degree of brightness or luminance of the casting 8 being formed is detected by the brightness or luminance sensors 23 the outputs of which are delivered to their corresponding arithmetic units 24. In response to the detected brightness or luminance which varies, each arithmetic unit 24 computes the operating stroke of an actuator 22 which adjusts the gap between the opposing surfaces of the sub-core 4a (4b) and the side dam 2 and then delivers the operation instruction to the control device 25 of the actuator 22. In response to the operation instruction, the control device 25 causes the actuator 22 to move the sub-core 4a (4b) by a computed operation stroke so that the gap between the opposing surfaces of the sub-core 4a (4b) and the side dam 2 is varied and consequently the flow rate of melt 6 can be adjusted. Thus the pouring device in accordance with the present invention can be control the optimum growth of the solidified shell 7 at the triple-point zone.

So far described is the device for automatically adjusting the gap between the opposing surfaces of the side dam and the sub-core in response to variations of luminance or brightness of the edge of the casting being formed, but it is to be understood that the gap may be adjusted for each batch in response to quality of melt and its casting conditions.

According to the above-described preferred embodiments of the present invention, the flow rate of melt flowing over the surfaces of the side dams to the triple-point zones can be controlled to increase or decrease the same in response to the growing condition of the solidified shell at the triple-point zones, thereby preventing the solidified shell from abnormally growing at the triple-point zones and the edges of the casting from melting. Thus, according to the present invention, high-quality castings can be formed.

What is claimed is:

1. In combination, a pouring device and a pair of parallel cooling rolls for dual-roll type continuous casting machines, wherein a core is supported to be partially submerged in a basin defined by said pair of parallel cooling rolls as well as side dams disposed at both end faces of said cooling rolls, said core being formed with side-dam-wise flow passages at opposite end faces for supplying melt through said core and said opposite end faces of said core in an axial direction of the cooling rolls, an improvement comprising movable means associated with said end faces for controlling, in relation to the side dams, the flow rate of melt flowing through said side-dam-wise flow passages toward inner surfaces of said side dams.

2. The combination according to claim 1, wherein each said movable means is formed with a vertical flow passage in communication with its respective side-dam-wise flow passage, a horizontal flow passage in communication with said vertical flow passage being defined by a lower end surface of said movable means as well as a horizontal step formed at each of lower portions of said end faces of the core, means being provided for vertical movement of said movable means, whereby the cross sectional area of said horizontal flow passage is varied.

3. The combination according to claim 1, wherein each said movable means comprises two plates disposed oppositely with respect to an opening of its respective side-dam-wise flow passage at each end face of said core such that they define a vertical flow passage in communication with said side-dam-wise flow passage, means for sliding said two plates toward or away from each other along the corresponding end face of said core, whereby the cross sectional area of said vertical flow passage is varied.

4. The combination according to claim 1, wherein each said movable means comprises two plates disposed oppositely with respect to an opening of its respective side-dam-wise flow passage at each end face of said core such that they define a vertical flow passage in communication with said side-dam-wise flow passage, means corresponding pivot pin for mounting said two plates for swinging movement about the corresponding end surface of the lower end of the face of said core to move said two plates toward or away from each other, whereby the cross sectional area of said vertical flow passage is varied.

5. The combination according to claim 1, wherein said core itself is divided in the axial direction of said cooling rolls into sub-cores which are supported movably in the axial direction of said cooling rolls to act as said movable means, whereby a gap between each of the side dams and the corresponding end face of the core is adjusted.

6. The combination according to claim 5 wherein said core is divided into two sub-cores.

7. The combination according to claim 5 wherein said sub-cores are moved by actuators.

8. The combination according to claim 7, wherein said actuators are automatically actuated in response to information obtained from sensor means which detect edge conditions of a casting being formed.

* * * * *